US007295094B2

(12) United States Patent
Jitaru et al.

(10) Patent No.: US 7,295,094 B2
(45) Date of Patent: Nov. 13, 2007

(54) LOW PROFILE MAGNETIC ELEMENT

(75) Inventors: Ionel D. Jitaru, Tucson, AZ (US); Marco A. Davila, Tucson, AZ (US)

(73) Assignee: DET International Holding Limited, Grand Cayman (KY)

( * ) Notice: Subject to any disclaimer, the term of this patent is extended or adjusted under 35 U.S.C. 154(b) by 79 days.

(21) Appl. No.: 10/512,128

(22) PCT Filed: Apr. 11, 2003

(86) PCT No.: PCT/CH03/00246

§ 371 (c)(1),
(2), (4) Date: Aug. 22, 2005

(87) PCT Pub. No.: WO03/088285

PCT Pub. Date: Oct. 23, 2003

(65) Prior Publication Data

US 2006/0006975 A1 Jan. 12, 2006

Related U.S. Application Data

(60) Provisional application No. 60/372,279, filed on Apr. 12, 2002.

(51) Int. Cl.
*H01F 5/00* (2006.01)

(52) U.S. Cl. ..... 336/200; 336/232; 336/223; 29/602.1

(58) Field of Classification Search ..... 336/200, 336/223, 232; 29/602.1
See application file for complete search history.

(56) References Cited

U.S. PATENT DOCUMENTS 5,353,001 A * 10/1994 Meinel et al. ..... 336/83
5,508,673 A * 4/1996 Staszewski ..... 336/184
6,069,548 A 5/2000 Baarman et al.

(Continued)

FOREIGN PATENT DOCUMENTS

WO WO 00/11687 3/2000

*Primary Examiner*—Anh Mai
(74) *Attorney, Agent, or Firm*—Gallagher & Kennedy, P.C.; Thomas D. MacBlain

(57) ABSTRACT

A low profile magnetic element used in cooperation with a multilayer printed circuit board has two or more core arms penetrating the board from one outer surface to the other and a series of magnetic core elements, at least one on each side of the board, bridging pairs of the core arms to form a closed, unbranched flux path. Series-connected windings form a transformer primary and are wound on the core arms that penetrate the board. Parallel-connected windings form a transformer secondary and are also wound on the core arms. The series-connected windings and the parallel-connected windings may be buried windings printed on internal surfaces of the multilayer board. The connected in series primary windings all have the same number of turns and the parallel-connected secondary windings all have the same number of turns. The parallel secondary windings are connected in current additive fashion to afford a high current transformer output. Output treating circuitry can treat each output separately in parallel and identically, being connected between the winding outputs and their point of connection. The transformer core can be assembled entirely of C and I magnetic elements. In one embodiment, a pair of magnetic plates overlying the outer surfaces of the multilayer circuit board are in flux-conducting relation with all of the core arms penetrating the board.

32 Claims, 7 Drawing Sheets

U.S. PATENT DOCUMENTS 6,650,217 B1 * 11/2003 Wolf et al. ..... 336/178
2001/0020886 A1 9/2001 Matsumoto et al.
2004/0057258 A1 * 3/2004 Dobrowolski ..... 363/59

* cited by examiner

LOW PROFILE MAGNETIC ELEMENT

CROSS REFERENCE TO RELATED APPLICATIONS

Priority is claimed from U.S. provisional patent application Ser. No. 60/372,279 entitled "Low Profile Magnetic Element" filed Apr. 12, 2002 in the name Ionel D. Jitaru and Marco Davila. That application is incorporated herein by reference.

FIELD OF THE INVENTION

This invention relates to mechanical construction and its electrical results for planar inductors and planar transformers used in power conversion.

BACKGROUND OF THE INVENTION

The industry demand for increasing power density and lowering the height of power converters imposed the use of planar inductors and planar transformers. The continuous trend for lower voltages and higher current has set new challenges for power magnetic components such as transformers. In order to simplify and control the manufacturing process for power magnetic components, the windings are embedded or buried within multilayer PCB structures. In such applications the copper thickness is limited. This limitation will exclude applications wherein large currents are processed, which today is the growing trend. One solution to overcome this problem is to split the current and process each section of it before it is provided to the output. Because the power dissipated due to the DC impedance is proportional with the square of the current, splitting the current, for example in two sections will reduce by a factor of four the power dissipation due to the DC impedance. Another limitation comes from the semiconductor devices. The trend towards miniaturization has forced the design to use surface mounted, smaller packages for semiconductor devices. These devices will accommodate only a limited die size, i.e., a semiconductor layer or layers of limited size. As a result, such devices provide only a limited current capability.

In FIG. 2 appears a prior art approach of splitting the output current wherein several transformers are employed. The primaries 16, 20 and 24 of the transformers 10, 12 and 14 are in series and the currents in secondaries 18, 22 and 26 are processed in parallel. The secondary windings can be placed in parallel directly or paralleled after the rectifiers (not shown). This concept, also described in U.S. Pat. Nos. 5,990,776 and 6,046,918 of Jitaru, both incorporated herein by reference, offers several advantages. First it splits the output current, which is further processed (rectified) on parallel paths, before it unites at the output of the converter. By placing several transformers in series the voltage across each primary winding is decreased, and as a result the number of turns in the primary winding can be reduced. A reduced number of turns will decrease the leakage inductance, which is proportional with the square of the number of turns. The use of smaller transformer, and as a result, a smaller magnetic core, will allow a better cooling due to an increased core surface area to volume ratio, will decrease the eddy current losses in the magnetic core due to a thinner core, and will prevent the electromagnetic resonant losses associated with very large magnetic cores.

One major drawback of this concept is the fact that the magnetizing inductance is lower, leading to larger magnetizing current and as a result lower efficiency. This is due to the fact that the magnetizing inductance is proportional with the square of the number of turns, and the total magnetizing inductance for the magnetic structure from FIG. 2 is the summation of all the magnetizing inductances. If there are used "n" independent transformers each of them with a number of turns in primary "N", the magnetizing inductance of the structure is $L_m = nKN^2$.

There remains therefore a need for an improved magnetic component with a better core and winding relationship. In particular, there remains a need for a transformer structure that splits the secondary current for parallel processing, uses a small core wound with series-connected primary windings, and produces an increased magnetizing flux for higher efficiency.

SUMMARY OF THE INVENTION

The magnetic component structure of this invention provides an improved magnetic core and winding arrangement. For transformer construction, it is highly suitable for higher current applications. The invention will allow a reduction in the core volume while the current in the secondary is split to minimize the conduction losses. As a consequence the invention leads to lower core loss, and lower conduction losses in a transformer structure.

In the structure depicted in FIG. 3, according to this invention, a number "n" of transformer windings are linked by the same flux and therefore $L_m = K(nN)^2$. The result is a much larger magnetizing inductance, lower magnetizing current and, consequently, lower losses.

In accordance with the invention, a magnetic circuit element includes a circuit board with at least two flux-conducting magnetic core arms or segments penetrating the board and at least two flux-conducting magnetic elements extending between the core arms on opposite sides of the board. At least one buried winding carried on an interior intermediate layer of a multilayer circuit board encircles or partially encircles one of the core arms or segments. The core arms and elements cooperate to form a flux path that is closed and unbranched. By "closed" is meant a flux path that returns upon itself as does the combination of C and I core sections; the term is not meant to exclude air gaps although the specific preferred exemplary embodiments described in detail below are without air gaps.

In the preferred embodiment of a transformer in accordance with this invention, at least two series-connected primary windings are imprinted or deposited on the board in encircling or partially encircling relation to at least one of the arms and at least two parallel-connected secondary windings are printed or deposited on the board in encircling or partially encircling relation to at least one of the arms. The board preferably is a multilayer circuit board and one or more of the windings are printed or deposited on a surface of a layer intermediate the outer surfaces of the board as buried windings. Preferably all of the windings are thus buried. In a preferred exemplary embodiment, the structure includes circuit components including one or more active or power components occupying locations on at least one of the outer surfaces of the circuit board directly above or below at least one of the buried windings, thus providing high power density.

The core sections that make up the magnetic flux path in accordance with the embodiments of the present invention are referred to variously as core elements, segments or arms. The core pieces that extend generally parallel to the faces of the board have been referred to as core "elements." These may be planar as that tern has become known in the art. I.e. these parts of the magnetic core can be "planar" in being low in profile and extending along the surface of a circuit board with a low generally planar upper surface so as not to greatly increase the circuit thickness. The terms "segments" and "arms" have been used to refer to the core sections located in holes in the circuit board, penetrating the board from one outer face to the other. The core "elements" and "segments" or "arms" are not necessarily distinct or separable pieces of the core. For example, when the core is formed in whole or in part of "C cores" or "C core sections," these "elements" are the integral spanning central part of the "C" that joins together the two parallel arms of the C, the bight as it were. In that case the two ends of the C are the segments or arms that penetrate the board.

Preferably, in one transformer formed in accordance with the invention, every primary winding that is connected in series has the same number of turns as every other primary winding. Likewise, every parallel-connected secondary winding has the same number of turns as every other secondary winding. Preferably, each primary winding is closely coupled to a secondary winding.

The magnetic core of this invention has a good surface to volume ratio. The absence of intermediate branching flux paths permits greater space for the windings inward of the closed magnetic circuit that the core forms. Each core arm penetrating the board and each core element bridging a pair of core arms can be fashioned from a magnetic C core section or a magnetic I core section. In one particular exemplary embodiment, the core elements bridging the penetrating core arms comprise a pair of magnetic plates overlying the two exterior surfaces of the circuit board. In this embodiment, each plate may be in flux conducting relation to all of the core arms penetrating the circuit board.

The invention includes, in a preferred exemplary embodiment, the method of power conversion for providing high amperage, low voltage power including the formation of a printed circuit board, forming holes through the board, locating magnetic core arms in those holes, locating magnetic core elements in flux-conducting relation between the arms on opposite faces of the board to form a transformer core, and winding on the core arms a plurality of series-connected windings and a plurality of parallel-connected windings on the core arms to form, respectively, a transformer primary and a transformer secondary. Preferably, winding the plurality of series-connected windings and parallel-connected windings is by printing or depositing the windings on surfaces of the board in encircling or partially encircling relation to a core arm. Preferably, too, the printing or depositing of the windings, at least in one or more occurrences, is again on a surface of a layer that is to be located intermediate the outer surfaces of the board, whereby these windings become buried windings in a multilayer circuit board.

The invention preferably includes a multilayer printed circuit board made by the foregoing process and having the characteristics described above. Such a printed circuit can accomplish high current high power density, good heat dissipation, and high magnetizing flux linking all windings for high efficiency.

The above and further objects and advantages of the invention will be better understood from the following detailed description of at least one preferred embodiment of the invention, taken in consideration with the accompanying drawings.

DETAILED DESCRIPTION

Figure 2:
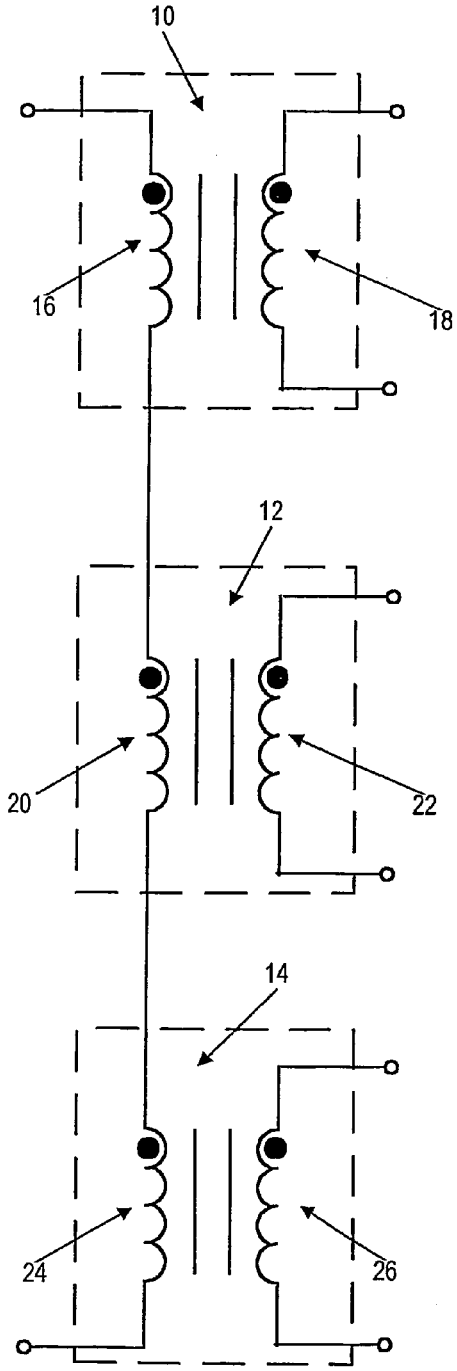
Fig. 2 Prior Art
FIG. 2 is a schematic illustration of the prior art transformer configuration for splitting the output current.
Figure 3:
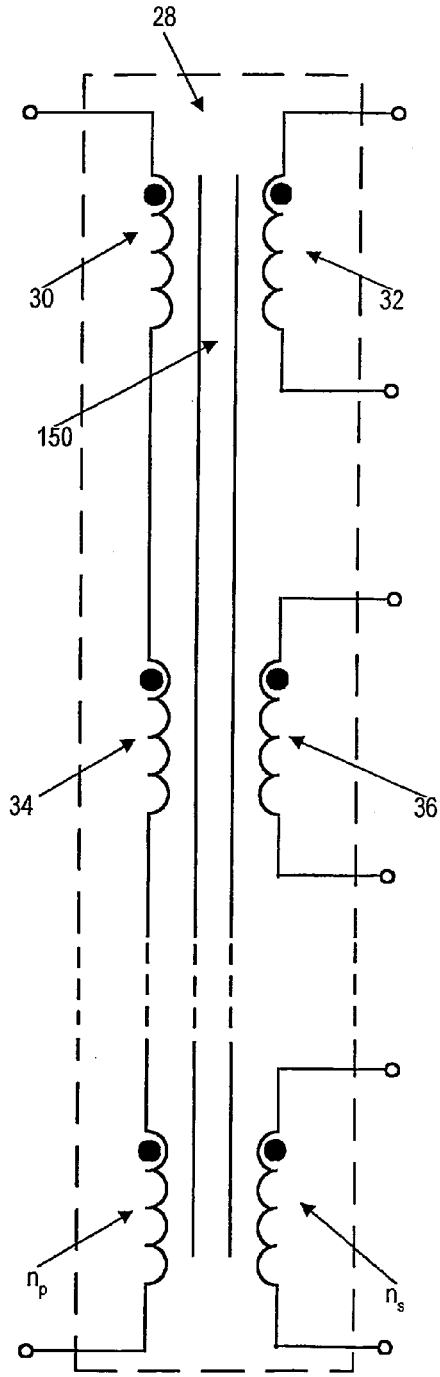
FIG. 3 is a schematic illustration of one embodiment of a transformer configuration according to the invention for splitting the output current.

Turning to FIG. 3, a transformer structure 28 according to the invention is shown schematically. To split the output current, independent secondary windings are used, such as 32, 36 . . . $n_s$. Typically, for high current, these secondary windings have only one turn. Primary windings of the transformer 28 are also split in the same number of sections as the secondary. These sections 30, 34 . . . $n_p$ are close coupled with their equivalent secondary 32, 36 . . . $n_s$. In this way a close coupling between primary and secondary is formed. The magnetic flux in a magnetic core 150 used by the structure 28 links all of the windings. For comparison, FIG. 2 is a schematic representing the prior art concept wherein independent transformer structures are used for splitting the output current. As mentioned before, in this prior art approach, the magnetizing current is lower and it leads to a larger magnetizing current and lower efficiency.

Figure 1:
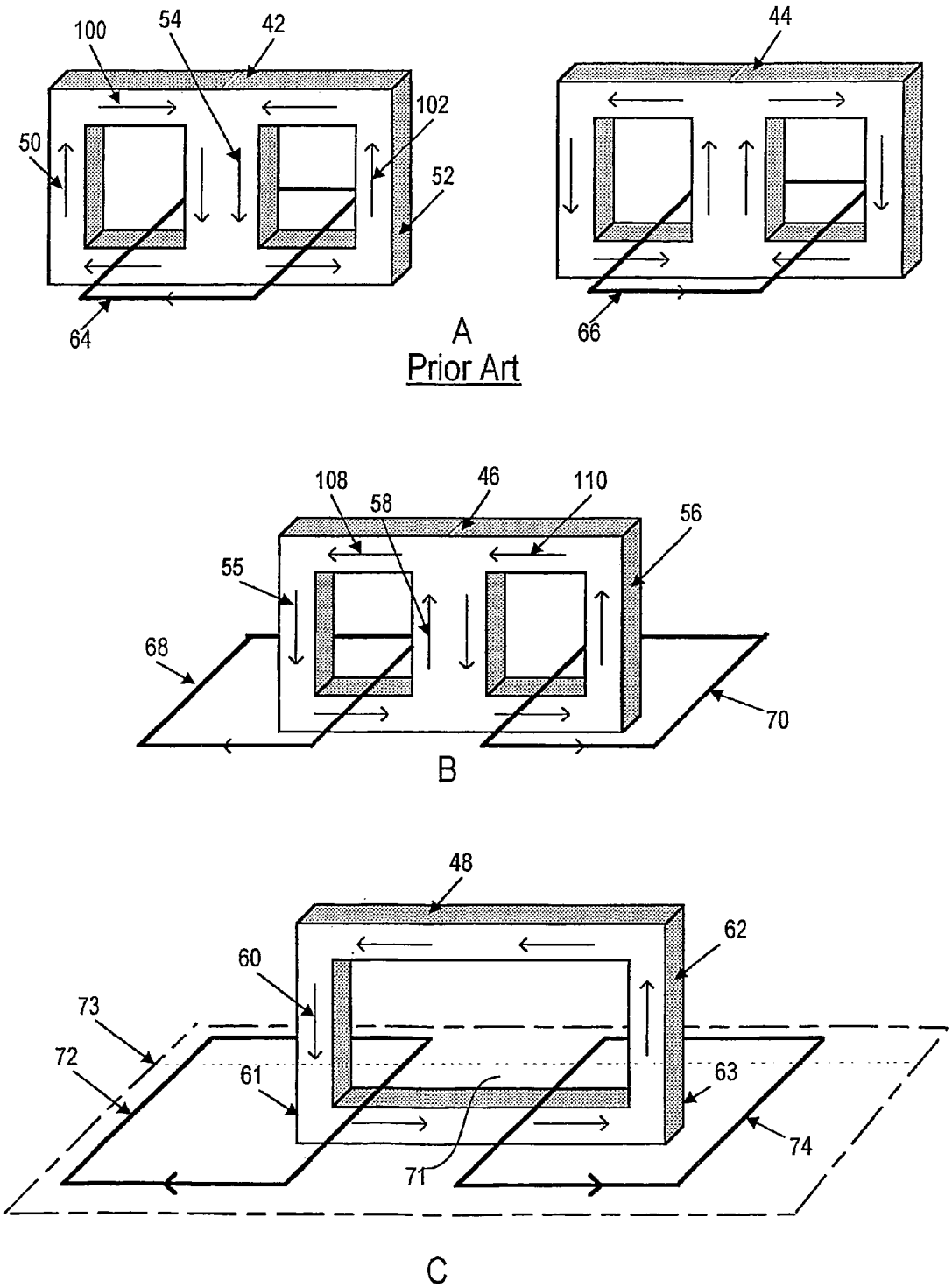
FIG. 1A is a diagrammatic illustration of the prior art wherein two magnetic cores are utilized.
FIG. 1B is a diagrammatic illustration of an improvement of the prior art wherein only one magnetic core is employed.
FIG. 1C is a diagrammatic illustration of an embodiment of this invention.

FIG. 1 demonstrates the transition from the prior art implementation to the structure of this invention. In FIG. 1A two transformers 42, 44 are formed by two E cores or by an E & I core configuration. Each transformer has a one turn winding 64, 66, which surrounds the center leg. In the transformer 42 flux through the outer legs 50, 52 of the magnetic core is shown. The flux 100, through the outer leg 50, and the flux 102, through the outer leg 52, unite into the center leg 54.

FIG. 1B illustrates an improvement of the original structure wherein the two transformers merge into only one, 46. There is a one turn winding 68, 70 surrounding or encircling each leg 55 and 56. The fluxes 108, 110 generated by the current flowing through the winding 68 and 70 merge into the center leg 58 of the transformer. If the current flowing through the winding 68 is equal to the current flowing through the winding 70, the flux flowing through the center leg 58 is zero.

A first embodiment of this invention is, then, depicted in FIG. 1C. Since, for equal currents flowing through windings 68 and 70 of the FIG. 1B arrangement, the flux through the center leg is zero, the next step is to remove the center leg. In the case of the transformer 48 of FIG. 1C, then, the E core configuration of FIGS. 1A and 1B is changed to a pair of C core (or C & I cores) to form the transformer core. The flux path formed, then, no longer branches. One advantage of this is an increase in the winding area 71, i.e. the area inside the core available for windings. Another advantage is a decrease in core loss due to a decrease of magnetic core volume. In FIG. 1C, a printed circuit board is indicated at 73. Vertical core arms 61 and 63 penetrate the board 73. The core 62, thus formed, is an unbranched or branchless core forming a closed flux path linking each winding 72 and 74 with the same flux 60.

Figure 4:
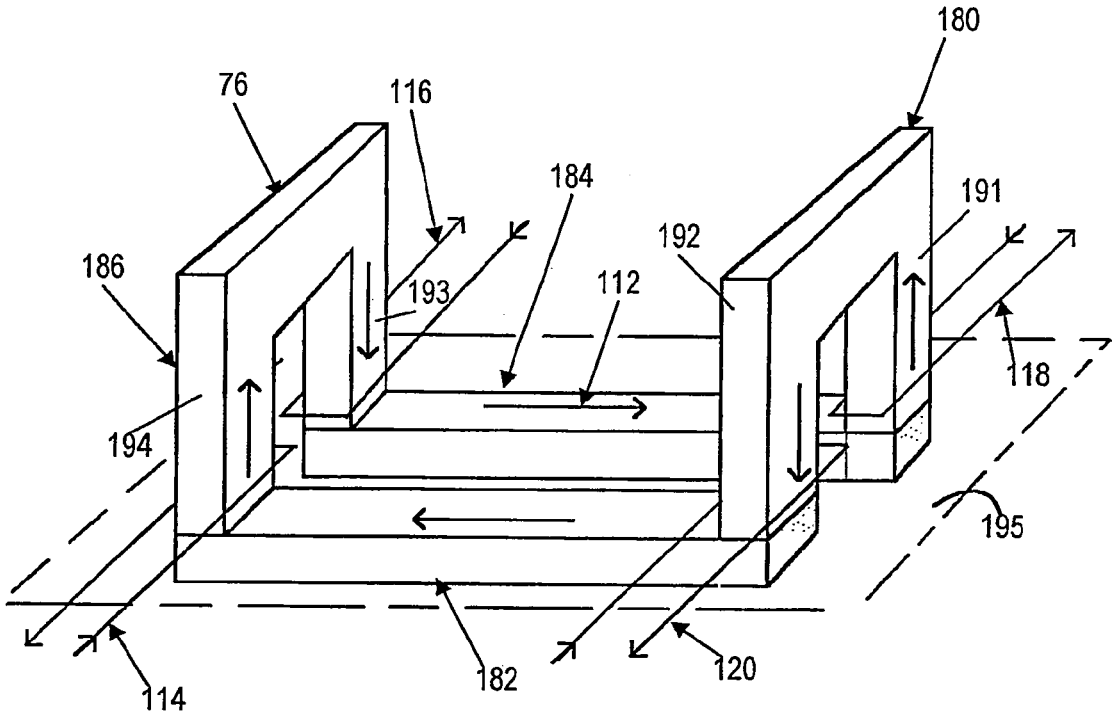
FIG. 4 is a diagrammatic illustration of another embodiment of this invention for splitting the output current in four sections.

In FIG. 4 an embodiment of the invention extends the concept depicted in FIG. 1C to a four winding structure, forming a magnetic structure 76. Windings 116, 114, 120 and 118 carry the same current. A flux 112 flows through the C cores 180, 186 and through the I cores 182, 184. Like the core structure of FIG. 1C, the core structure of FIG. 4 can be also constructed by using only C core members or only I core members, without departing from the spirit of the invention. The parallel arms 191, 192 and 193, 194 of the two C cores 180 and 186 are brought together end to end with the two coplanar I cores 182 and 184. This arrangement of the magnetic cores pieces resembles the assembled core pieces of FIG. 1C. Again, the same flux links all windings. The core is, once more, an unbranched, closed flux path. The core arms 191-194 penetrate a circuit board indicated as 195 on which the windings 116, 114, 120 and 118 may be printed or deposited to encircle or partially encircle the core legs.

Figure 5:
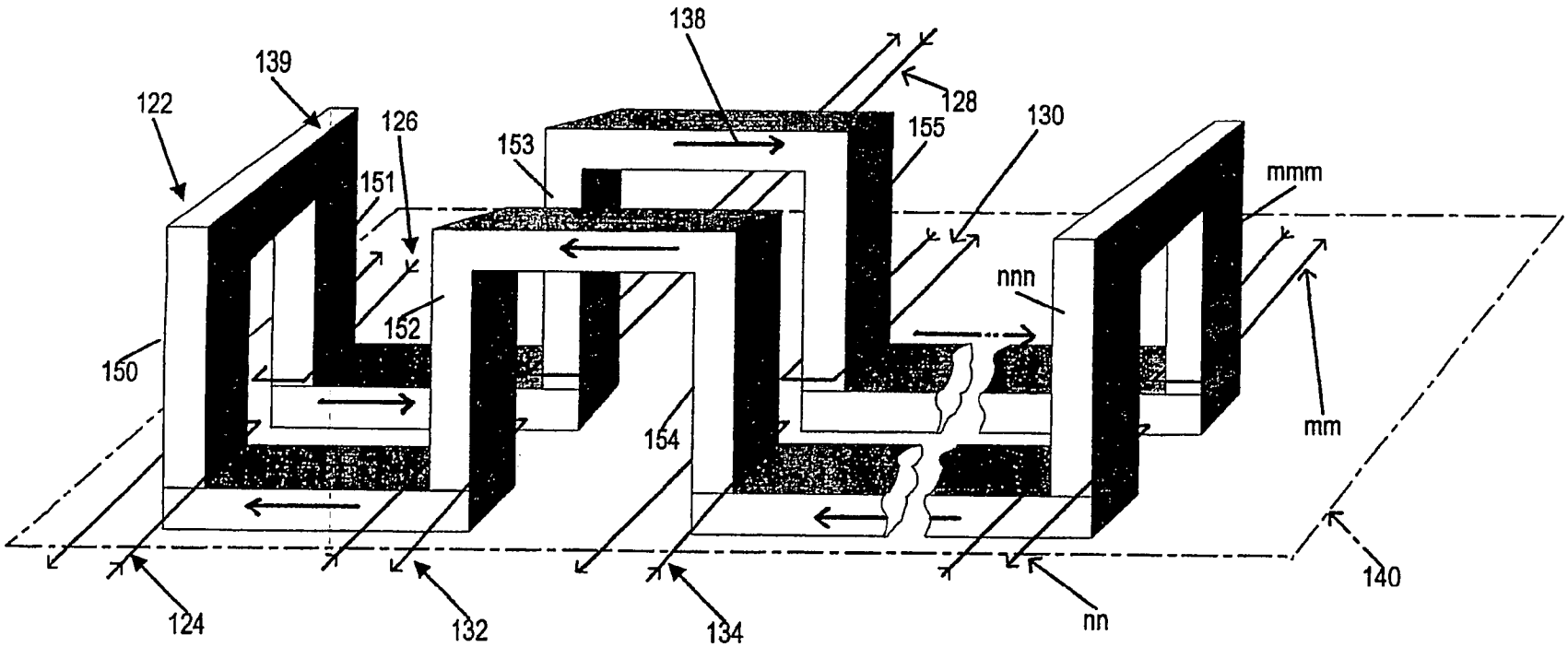
FIG. 5 is a diagrammatic illustration of another embodiment of this invention for further splitting the output current in "n" sections.

FIG. 5 illustrates an embodiment of the invention that is a further extension of the concept described with respect to FIG. 1C. It illustrates how the concept of this invention can be applied to any number of windings that is a multiple of two. The current flowing through the depicted windings 124, 126, 128, 130, 132, 134, nn and mm is equal. This leads to an equal flux 138 flowing through each of the elements of the magnetic core. The magnetic structure 122, then, is a generalization of the concept described with respect to FIG. 1C. The core 139 can be composed entirely of C or I members or combinations of the two. A circuit board is indicated at 140 and is of course penetrated by the core arms 150, 151, 152, 153, 154-mmm, nnn, which are encircled or partially encircled by the windings 124, 126, 128, 130, 132, 134-mm, nn. The flux path is closed and unbranched. All windings are linked by the same flux.

Figure 6:
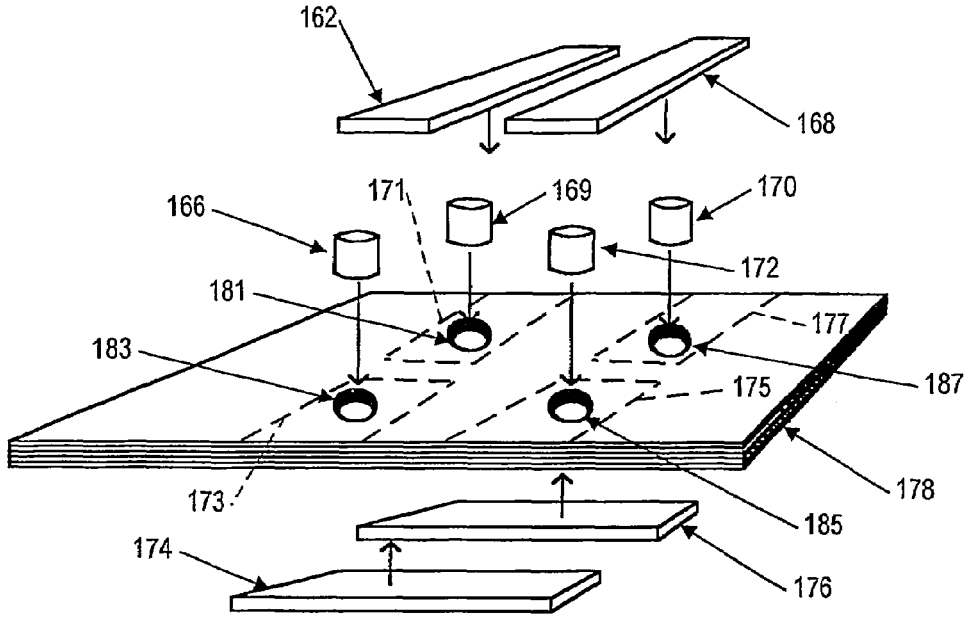
FIG. 6 is an exploded diagrammatic view that illustrates an embodiment of the invention and shows a mechanical construction of one embodiment of the present invention including a multilayer printed circuit board.

In FIG. 6 an embodiment of the invention provides a mechanical configuration that offers practical application of the described concepts. It applies to a planar magnetic using a multilayer circuit board. The windings indicated by the dashed lines 171, 173, 175 and 177, are embedded into the multilayer circuit board 178. Multilayer printed circuit boards having electrically conductive buried windings at least partially encircling core portions that extend through the board are disclosed in the incorporated U.S. Pat. No. 5,990,776 of Jitaru. The windings here surround the holes 181, 183, 185 and 187. A series of cylindrical core arms 166, 169, 170, 172 made of magnetic material are placed into the holes 181, 183, 185 and 187. These serve as the arms of the magnetic core. Made also of magnetic material, a series of plate-shaped elements 162, 168, 174 and 176 is secured by conventional means to the tops and bottoms of the cylinders 166, 169, 170, 172 in the relationship shown. The configuration depicted in FIG. 6 is a practical implementation of the structure depicted in FIG. 4.

Figure 7:
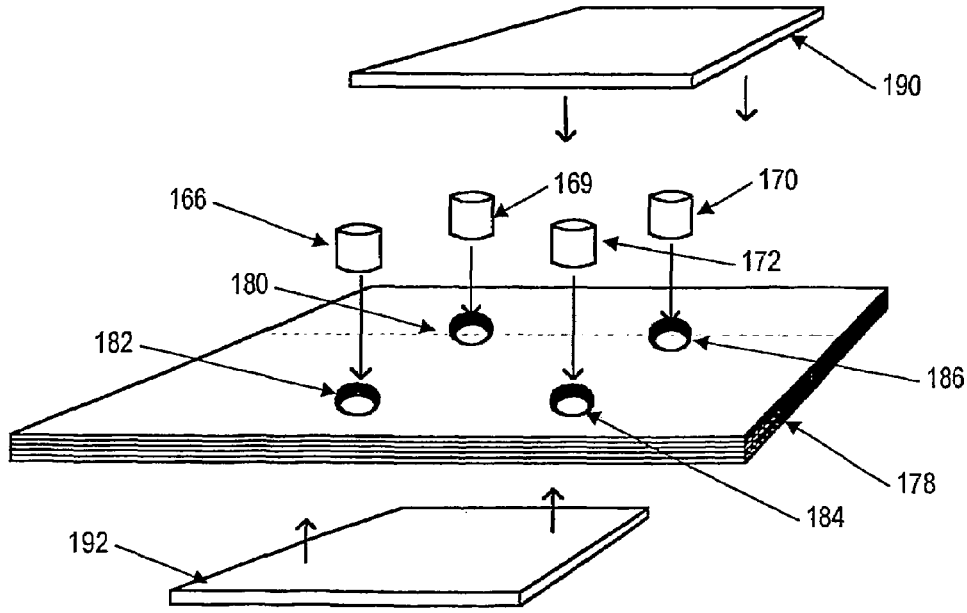
FIG. 7 is another exploded diagrammatic view and shows the mechanical construction of a further embodiment of the present invention.

FIG. 7 illustrates a further embodiment of the invention in which the magnetic plates 162, 168, 174 and 176 of FIG. 6 are replaced by just two magnetic plate elements 190 and 192 affixed to the cylindrical core arms 166, 169, 170 and 172 at their tops and bottoms. The advantages of using standard building elements, magnetic plates and magnetic cylinders are numerous. First of all it offers an economical solution in addressing the magnetic design for different power levels. More elements are employed as a function of the output current requirements. The basic cell uses a core of just two plates and two cylinders. From this cell one can extend to as many winding outputs as needed.

Figure 8:
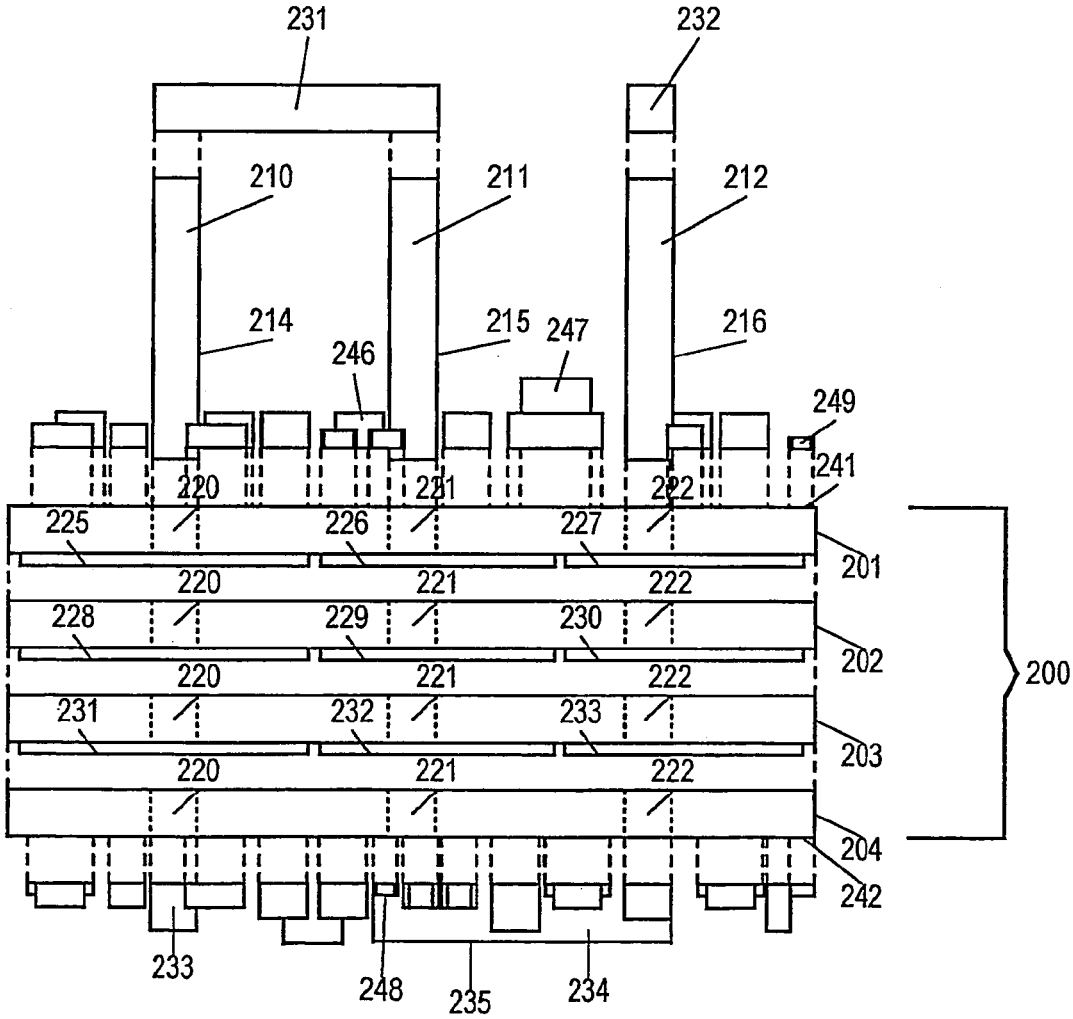
FIG. 8 is a diagrammatic, partially exploded view illustrating the relationship of a multilayer board with a transformer formed in accordance with the invention.

In FIG. 8, layers 201, 202, 203 and 204 make up a multilayer circuit board 200. Magnetic core arms 210, 211 and 212 mask from view similar magnetic core arms 214, 215 and 216. Openings 220, 221 and 222 form holes through the assembled board receiving the core arms 210, 211 and 212. The core arms 214, 215 and 216 are similarly received in holes through the board masked from view in FIG. 8.

About each of the core arms 210, 211, 212, 214, 215, and 216, is wound at least one winding 225-233. These are printed on the layers of the multilayer board and become buried windings. Magnetic core elements 240, 241, 242 and 243 extend parallel the upper and lower surfaces of the board. The magnetic core element 231 connects the ends of the core elements 210 and 211 in flux-conducting relation. The core element 234 connects the ends of the core arms 211 and 212 similarly. The core element 232 connects the core arms 212 and 216. A further, masked core element 235 lies behind the core element 234 in FIG. 8 and connects the ends of the core arms 216 and 215. Similarly, a masked core element 236 lies behind the core element 231 connecting the core arms 214 and 215. Finally, completing the magnetic circuit formed by the core members, the core element 233 bridges core arms 210 and 214. It will be appreciated that the core members, thus constructed, form a single, closed, unbranched flux path. Circuit components can be seen on the upper and lower faces 241 and 242 of the board 200. At least some of these elements lie directly over or under the buried windings 225-233. Of those, at least certain of the components such as the components 246 and 247 are active or power components, whereas others such as 248 and 249 are passive components. The lack of any branching core path and the availability of much of the upper and lower surfaces, even those above and below the windings, for location of circuit components contributes to excellent power density. The magnetic core, like those earlier described, can be formed entirely of C or I core pieces or of a combination of C and I pieces.

Figure 9:
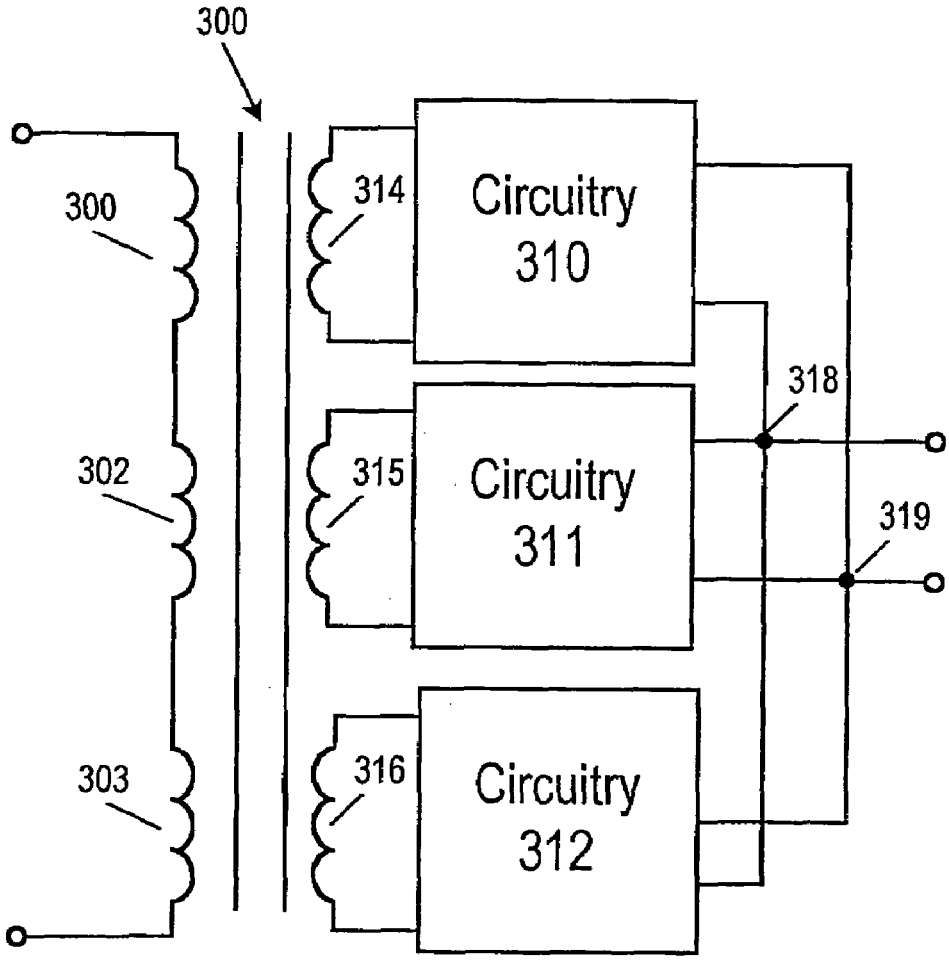
FIG. 9 is a schematic diagram, partially in block diagram form and illustrating the parallel treatment of secondary winding outputs.

FIG. 9 illustrates schematically a preferred embodiment of the invention in which the transformer 300 is like the transformer of FIG. 3. Series-connected windings 301, 302 and 303 form the primary. Circuitry 310, 311 and 312 treats the output of the parallel-connected windings 314, 315 and 316 that form the secondary of the transformer. The circuitry 310, 311 and 312 is connected between the secondary outputs and current additive nodes 318 and 319 at which the secondary windings are connected in parallel. The circuitry 310, 311 and 312 may be only the typical rectifying diodes or may include additional current treating elements.

The foregoing descriptions of preferred embodiments are exemplary and not intended to limit the invention claimed.

Obvious modifications that do not depart from the spirit and scope of the invention as claimed will be apparent to those skilled in the art.

We claim:

1. A magnetic circuit element including a circuit board, a plurality in excess of two flux-conducting magnetic core arms penetrating the board, a plurality in excess of two flux-conducting magnetic core elements extending between the magnet core arms in flux-conducting relation therewith, on both sides of the circuit board, at least two series-connected primary windings on the board in at least partially encircling relation to at least one of the arms and at least two parallel-connected secondary windings on the board in at least partially encircling relation to at least one of the arms wherein the core arms and core elements are serially linked to form a single, unbranched, closed flux path, whereby all of the primary and secondary windings are linked by the same flux.

2. The magnetic circuit element according to claim 1, wherein the circuit board is a multilayer circuit board and at least one of the windings is a buried winding located between layers of the multilayer circuit board.

3. The magnetic circuit element according to claim 2, wherein each of the windings is a buried winding located between layers of the multilayer circuit board.

4. The magnetic circuit element according to claim 2, further comprising circuit components, including one or more power components, occupying at least one outer surface of the circuit board above or below the at least one buried winding.

5. The magnetic circuit element according to claim 1, wherein each of the primary windings has substantially the same number of turns as each other secondary winding.

6. The magnetic circuit element according to claim 5, wherein each of the secondary windings has substantially the same number of turns as each other secondary winding.

7. The magnetic circuit element according to claim 1, wherein the number of primary windings is the same as the number of secondary windings, each primary winding being wound in closely coupled relation to a secondary winding.

8. The magnetic circuit element according to claim 6, wherein the number of primary windings is the same as the number of secondary windings, each primary winding being wound in closely coupled relation to a secondary winding.

9. The magnetic circuit element according to claim 2, wherein all of the core arms and core elements are selected from the group consisting of C and I elements.

10. A magnetic circuit element including a circuit board, plurality of flux-conducting magnetic core arms penetrating the board, a plurality of flux-conducting magnetic core elements extending between the magnet core arms on both sides of the circuit board, at least two series-connected primary windings on the board in at least partially encircling relation to at least one of the arms and at least two parallel-connected secondary windings on the board in at least partially encircling relation to at least one of the arms wherein the core arms and core elements are serially linked to form a single, unbranched, closed flux path, whereby all of the primary and secondary windings are linked by the same flux, the magnetic circuit element having an even number of core arms in excess of two.

11. The magnetic circuit element according to claim 10, having in excess of two magnetic core arms penetrating the board, each core arm being wound with at least one of the primary and secondary windings.

12. The magnetic circuit element according to claim 11, wherein each core arm is wound with at least one of the primary windings and at least one of the secondary windings.

13. A multilayer printed circuit board of the kind having first and second surfaces on first and second sides of the board and including a transformer with windings defined between layers of the board and a transformer core penetrating the layers of the board and about which the windings are wound; the improvement comprising; a plurality of at least four magnetic core segments extending through the board from the first side to the second side at spaced apart locations;

a) said windings comprising a plurality of at least four windings, each at least partially encircling a separate one of the core segments where the core segments extend through the board;

b) a plurality of substantially planar first magnetic core elements at the first side of the board, each of the first core elements extending between a pair of the magnetic core segments in flux-conducting relation thereto such that each core segment at the first side of the board is joined in flux-conducting relation to another of the core segments by one of the substantial planar core elements at the first side of the board; and c) a plurality of substantially planar second magnetic core elements at the second side of the board, each of the second magnetic core elements at the second side of the board extending between a pair of the magnetic core segments in flux-conducting relation thereto, each pair of core segments between which a second magnetic core element extends at the second side of the board being in a separate pair of the core segments joined in flux-conducting relation by first magnetic core elements at the first side of the board;

the magnetic core elements and core segments forming an unbranched, closed magnetic flux path extending across the first and second faces and through the layers of the board.

14. A method of power conversion for providing high amperage, low voltage power including:

(a) providing a printed circuit board, (b) forming in excess of two holes through the printed circuit board, (c) locating magnetic core arms in each of the holes formed in the printed circuit board, (d) locating magnetic core elements in flux-conducting relation between the core arms on opposite faces of the printed circuit board to form a transformer core that has a single, unbranched, closed flux path incorporating each of the core arms and core elements, (e) winding a plurality of series-connected windings, on the core arms to form a transformer primary, (f) winding a plurality of parallel-connected windings, on the core arms to form a transformer secondary.

15. The method according to claim 14, further comprising providing a plurality of output treating circuits at the output of each of the windings forming the secondary, the output heating circuits being connected between these windings and a current additive point of connection of the windings.

16. The method according to claim 14, wherein the steps of winding the series-connected windings and winding the parallel-connected windings comprises winding at least one of the series-connected windings in closely coupled relation to one of the parallel-connected windings on each of the core arms.

17. The method according to claim 16, wherein forming holes in the printed circuit board comprises forming in excess of two holes therein, and the step of locating magnetic core arms in the holes comprises locating in excess of two core arms, winding a plurality of series-connected windings comprises winding in excess of two series-connected windings on the core arms, and winding a plurality of parallel-connected windings comprises winding in excess of two parallel-connected windings on the core arms.

18. The method according to claim 17, wherein each step of winding comprises printing or depositing a winding on a surface of the printed circuit board in at least partially encircling relation to one of the core arms.

19. The method according to claim 14, wherein each step of winding comprises printing or depositing a winding on a surface of the printed circuit board in at least partially encircling relation to one of the core arms.

20. The method according to claim 14, wherein the step of providing a printed circuit board comprises providing a multilayer circuit board, and the steps of winding a plurality of series-connected and parallel-connected windings comprise providing at least a plurality of windings as buried windings on one or more layer surfaces intermediate the opposite faces of the printed circuit board.

21. A multilayer printed circuit comprising:

(a) a multilayer circuit board having first and second faces, (b) a transformer including:

(i) a magnetic core having:

(A) a plurality of core arms, each of which extends through a hole in the multilayer circuit board from the first face to the second face, (B) a plurality of magnetic core elements, each extending along the first or second surface between ends of the core arms to complete a magnetic circuit comprises of the core arms and core elements to form a single, branchiess, closed flux path, (C) at least two series-connected windings forming a transformer primary printed on the multilayer circuit board, each in at least partially encircling relation to a core arm, (D) at least two parallel-connected windings forming a transformer secondary printed on the multilayer circuit board, each in at least partially encircling relation to a core arm, and (E) each core arm extending through the multilayer circuit board having at least one of the windings of the transformer primary or secondary wound thereon, (c) transformer secondary output processing circuitry connected to the parallel-connected windinas, (i) each parallel-connected winding having substantially the same output processing circuitry connected thereto for similarly processing each parallel-connected winding output, (ii) the output processing circuitry being located between the parallel-connected windings and a point of interconnection thereof, whereby each winding couples the identical flux in the core.

22. The multilayer printed circuit according to claim 21, wherein each of the connected in parallel windings forming the transformer secondary has substantially the same number of turns as each other of the connected in parallel windings forming the transformer secondary.

23. The multilayer printed circuit according to claim 21, wherein the point of interconnection is current additive.

24. The multilayer printed circuit according to claim 21, wherein at least one of the windings forming the transformer primary and at least one of the windings forming the transformer secondary are buried windings printed on a face of a layer of the multilayer circuit board interior of the first and second faces.

25. The multilayer printed circuit according to claim 21, wherein each of the connected in series windings forming the transformer primary has substantially the same number of turns as each other of the connected in series windings forming the transformer primary.

26. The multilayer printed circuit according to claim 25, wherein each of the connected in parallel windings forming the transformer secondary has substantially the same number of turns as each other of the connected in parallel windings forming the transformer secondary.

27. The multilayer printed circuit according to claim 26, wherein on each of the core arms is wound at least one of the connected in series windings forming the transformer primary in closely coupled relation to at least one of the connected in parallel windings forming the transformer secondary.

28. The multilayer printed circuit according to claim 27, wherein the number of core arms is greater than two.

29. The multilayer printed circuit according to claim 28, wherein the core elements are plates overlying the first and second surfaces of the circuit board in flux communicating relation to each core arm.

30. A power magnetic component including:

(a) a multilayer circuit board having first and second exterior faces, (b) a magnetic core comprising:

(i) a plurality in excess of two magnetic segments extending through the circuit board from one exterior face to the other exterior face, (ii) a plurality in excess of two magnetic elements exterior of the circuit board, each magnetic element being mounted on or over one of the faces, and extending generally parallel to the faces of the board in flux conducting relation from one of the segments to another of the segments to form a single, closed, unbranched flux path, and (c) at least one buried winding carried on a surface of a layer of the multilayer circuit board intermediate the exterior faces and at least partially encircling one of the magnetic segments.

31. The power magnetic component according to claim 30, wherein the magnetic segments extending through the circuit board comprise at least four magnetic segments, and the magnetic elements exterior of the circuit board comprise at least two magnetic segments on opposite sides of the circuit board, all of said magnetic segments and magnetic elements being serially linked in flux conducting relation into said single, closed, unbranched flux path.

32. The power magnetic component according to claim 30, wherein the magnetic segments extending through the circuit board comprise at least six magnetic segments, and the magnetic elements exterior of the circuit board comprise at least four magnetic segments on opposite sides of the circuit board, all of said magnetic segments and magnetic elements being serially linked in flux conducting relation into said single, closed, unbranched flux path.

* * * * *